US006602171B1

(12) United States Patent
Tsen et al.

(10) Patent No.: US 6,602,171 B1
(45) Date of Patent: Aug. 5, 2003

(54) ABDOMINAL EXERCISER

(76) Inventors: Samson Tsen, No. 8, Lane 249, Lung-Chiang Road, Taipei (TW); Jin-Chen Chuang, No. 17, Lane 301, Nan-Yung Road, Fenyuan (TW)

( * ) Notice: Subject to any disclaimer, the term of this patent is extended or adjusted under 35 U.S.C. 154(b) by 0 days.

(21) Appl. No.: 10/058,468

(22) Filed: Jan. 28, 2002

(51) Int. Cl.[7] ..... A63B 26/00; A63B 71/00
(52) U.S. Cl. ..... 482/140
(58) Field of Search ..... 482/140

(56) References Cited

U.S. PATENT DOCUMENTS

| | | | | |
|---|---|---|---|---|
| 5,094,450 A | | 3/1992 | Stearns | |
| 5,599,261 A | | 2/1997 | Easley et al. | |
| 5,632,710 A | * | 5/1997 | England et al. | 482/127 |
| 6,248,047 B1 | * | 6/2001 | Abdo | 482/130 |

FOREIGN PATENT DOCUMENTS

| | | |
|---|---|---|
| CN | 2347615 Y | 11/1999 |
| CN | 2358930 Y | 1/2000 |

OTHER PUBLICATIONS

Search Report of Hong Kong Short–Term Patent Application No. HK: 02024, dated Feb. 22, 2002, pp. 4.

Search Report under Section 17 for Application No. GB 0201875.2, dated Jun. 20, 2002, pp. 1.

* cited by examiner

*Primary Examiner*—Nicholas D. Lucchesi
*Assistant Examiner*—Lori Baker Amerson
(74) *Attorney, Agent, or Firm*—Senniger, Powers, Leavitt & Roedel

(57) ABSTRACT

An abdominal exerciser, comprising: a base frame; a seat having a seat pad which is secured on the base frame; an upper arm having a first end and a second end; a lower arm having a first end and a second end, the first end of the lower arm connecting on and laterally extending from the base frame, the second end of the lower arm pivotally connecting to the first end of the upper arm; a vertical bar being located behind the seat pad and connecting with the second end of the upper arm, the vertical bar having a first end and a second end; a handle pivotally connecting to the first end of the vertical bar; and a resilient mechanism interconnecting the base frame and the second end of the vertical bar.

20 Claims, 18 Drawing Sheets

ABDOMINAL EXERCISER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to an exercising machine, specifically, to an abdominal exerciser for reducing fat around the abdomen.

2. Description of the Related Art

People of day usually have rich meals and drinks. If they have no regular exercise, obesity will happen to them, which not only changes their body shape, but also brings them into illness such as high blood pressure, diabetes, and heart problems. Among a variety of types of corpulence, the most common one is "barrel-shaped" abdomen, which means that excessive fat accumulates in the abdomen. Therefore, accumulated fat around the abdomen becomes a health issue to be solved.

Different from other exercising machines in the market, the present invention focuses on reducing fat around the abdomen so as to improve the user's health.

BRIEF SUMMARY OF THE INVENTION

A primary objective of the present invention is to provide an abdominal exerciser which can reduce fat around the abdomen, solve obesity problem, and improve users' health.

Another objective of the present invention is to provide an abdominal exerciser which can exercise the abdominal muscle to completely reduce fat around the abdomen.

A further objective of the present invention is to provide an exerciser which can also exercise the users' leg muscle while exercising their abdominal muscle.

To achieve the above objectives, the abdominal exerciser in accordance with the present invention comprises: a base frame; a seat having a seat pad which is secured on the base frame; an upper arm having a first end and a second end; a lower arm having a first end and a second end, the first end of the lower arm connecting on and laterally extending from the base frame, the second end of the lower arm pivotally connecting to the first end of the upper arm; a vertical bar being located behind the seat pad and connecting with the second end of the upper arm, the vertical bar having a first end and a second end; a handle pivotally connecting to the first end of the vertical bar; and a resilient mechanism interconnecting the base frame and the second end of the vertical bar.

The structure and objectives of the present invention can be more readily understood by persons skilled in the art from the following description of the preferred embodiments taken in conjunction with the accompanying drawings.

DETAILED DESCRIPTION OF THE INVENTION

Figure 1:
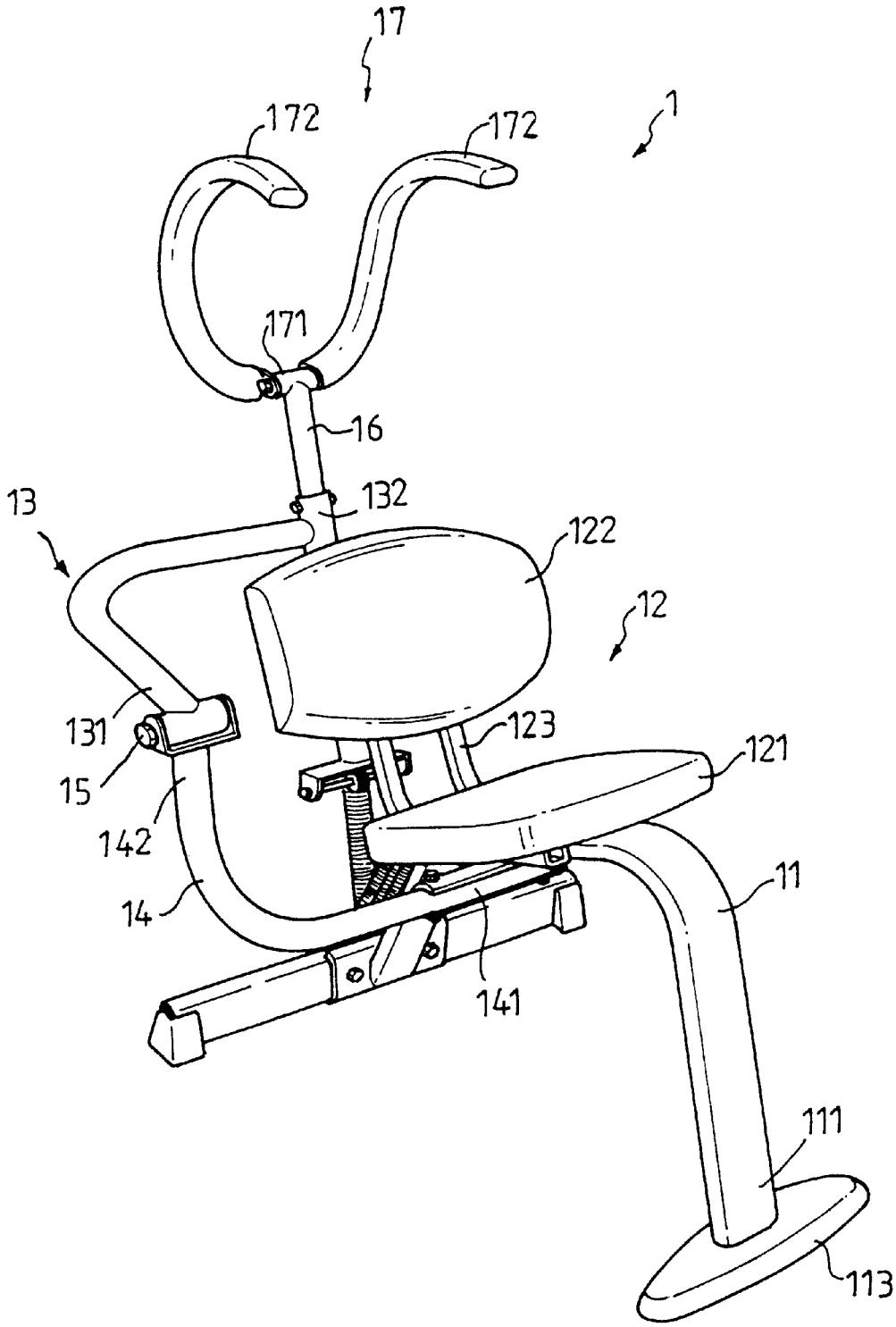
FIG. 1 is a front perspective view of an abdominal exerciser in accordance with the first preferred embodiment of the present invention.
Figure 2:
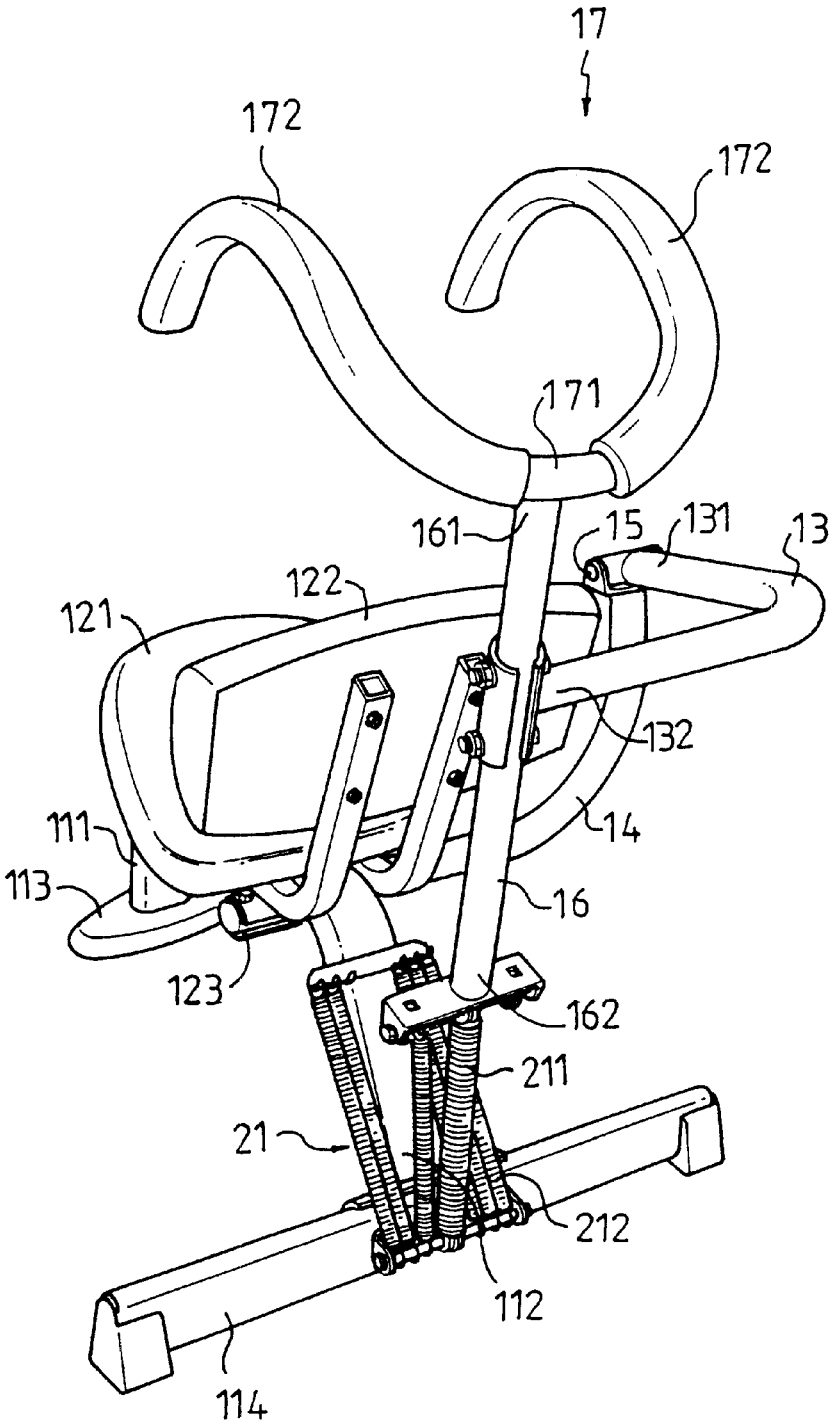
FIG. 2 is a rear perspective view of an abdominal exerciser in accordance with the first preferred embodiment of the present invention.
Figure 3:
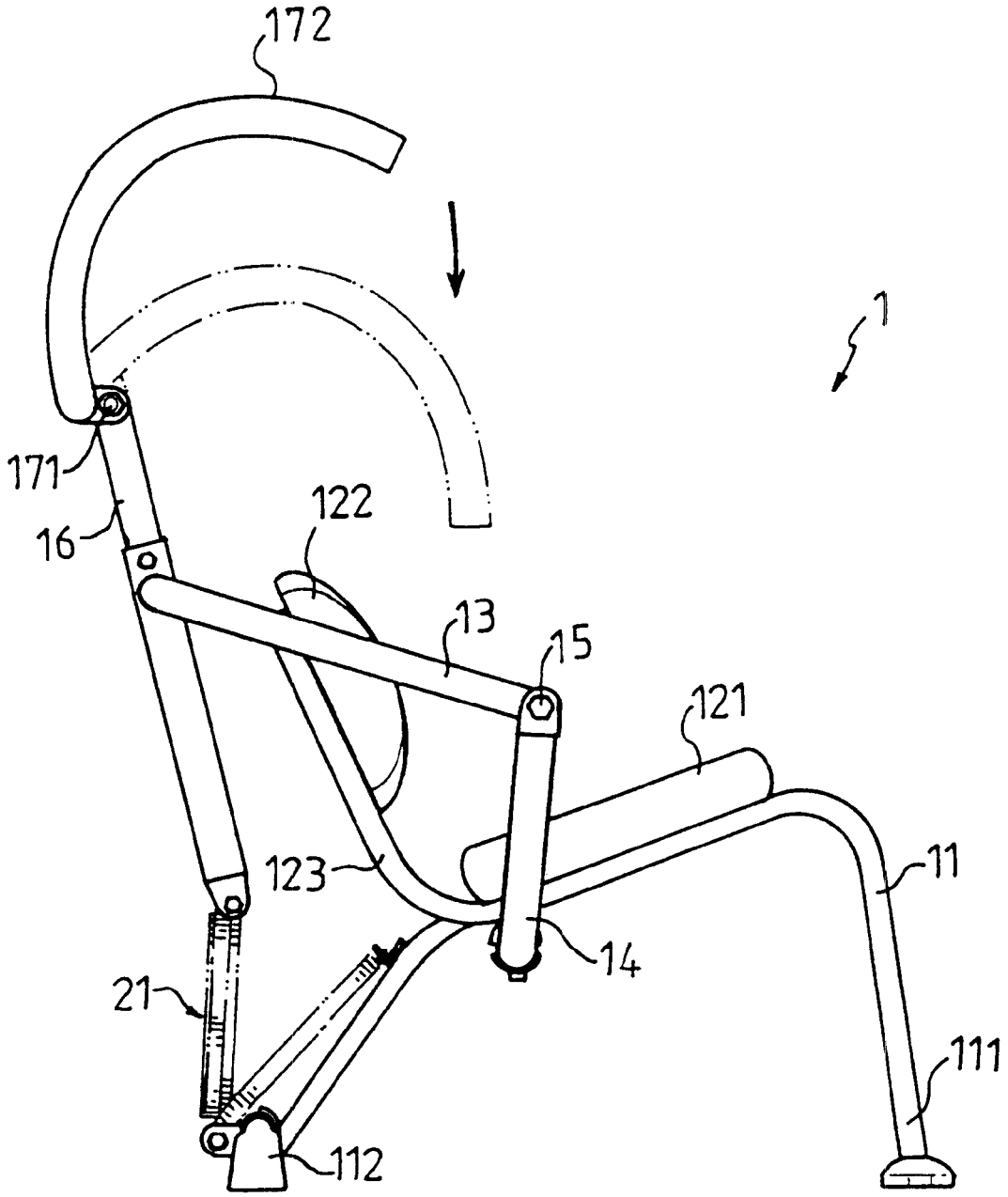
FIG. 3 is a left side operational view of an abdominal exerciser in accordance with the first preferred embodiment of the present invention.

FIGS. 1 and 2 are perspective views of an abdominal exerciser in accordance with the first preferred embodiment of the present invention and FIG. 3 is a side operational view therefor. As shown, the abdominal exerciser 1 comprises a base frame 11 and a seat 12.

The base frame 11 is substantially arched, and has a front end 111 and a rear end 112. The front end 111 and the rear end 112 of the base frame 11 are respectively provided with a front horizontal beam 113 and a rear horizontal beam 114 for stably placing the base frame 11 on the ground.

The seat 12 comprises a seat pad 121 and a back rest 122. The back rest 122 substantially perpendicularly connects to the seat pad 121 by means of a pair of substantially L-shaped support arms 123. The seat pad 121 is secured centrally onto the arched base frame 11 and, substantially onto the uppermost point of the base frame 11.

The abdominal exerciser 1 further comprises an L-shaped upper arm 13 and an L-shaped lower arm 14. Each arm 13, 14 has a first end 131, 141 and a second end 132, 142, respectively. The first end 141 of the lower arm 14 is secured to the base frame 11, near the uppermost point thereof, and laterally extends therefrom. By means of a pin, the second end 142 of the lower arm 14 pivotally connects to the first end 131 of the upper arm 13 at a pivot point 15. Based on the above arrangement, when the user sits on the seat 12, the pivot point 15 substantially aligns with the user's waist.

The second end 132 of the L-shaped upper arm 13 connects with a vertical bar 16, behind the back rest 122. The vertical bar 16 aligns with the base frame 11 and the seat 12, and has a first end 161 and a second end 162. The first end 161 of the vertical bar 16 pivotally connects to a middle point of a horizontal bar 171 of a handle 17. A handle grip 172 further extends from each end of the horizontal bar 171 and has a substantially hooked shape to comply with a user's shoulder.

Figure 4:
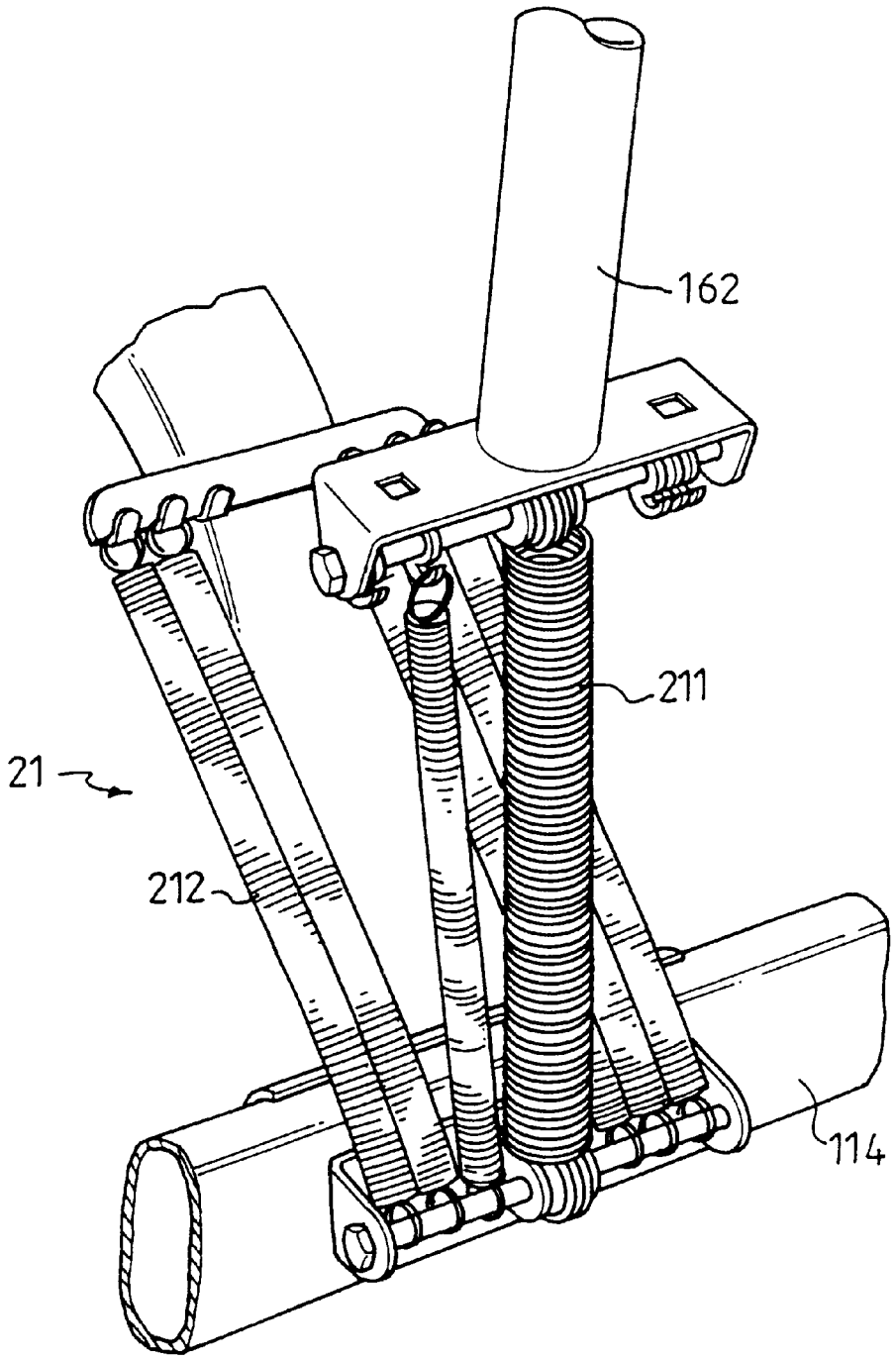
FIG. 4 is a partially enlarged view of the resilient mechanism shown in FIG. 2.
Figure 5A:
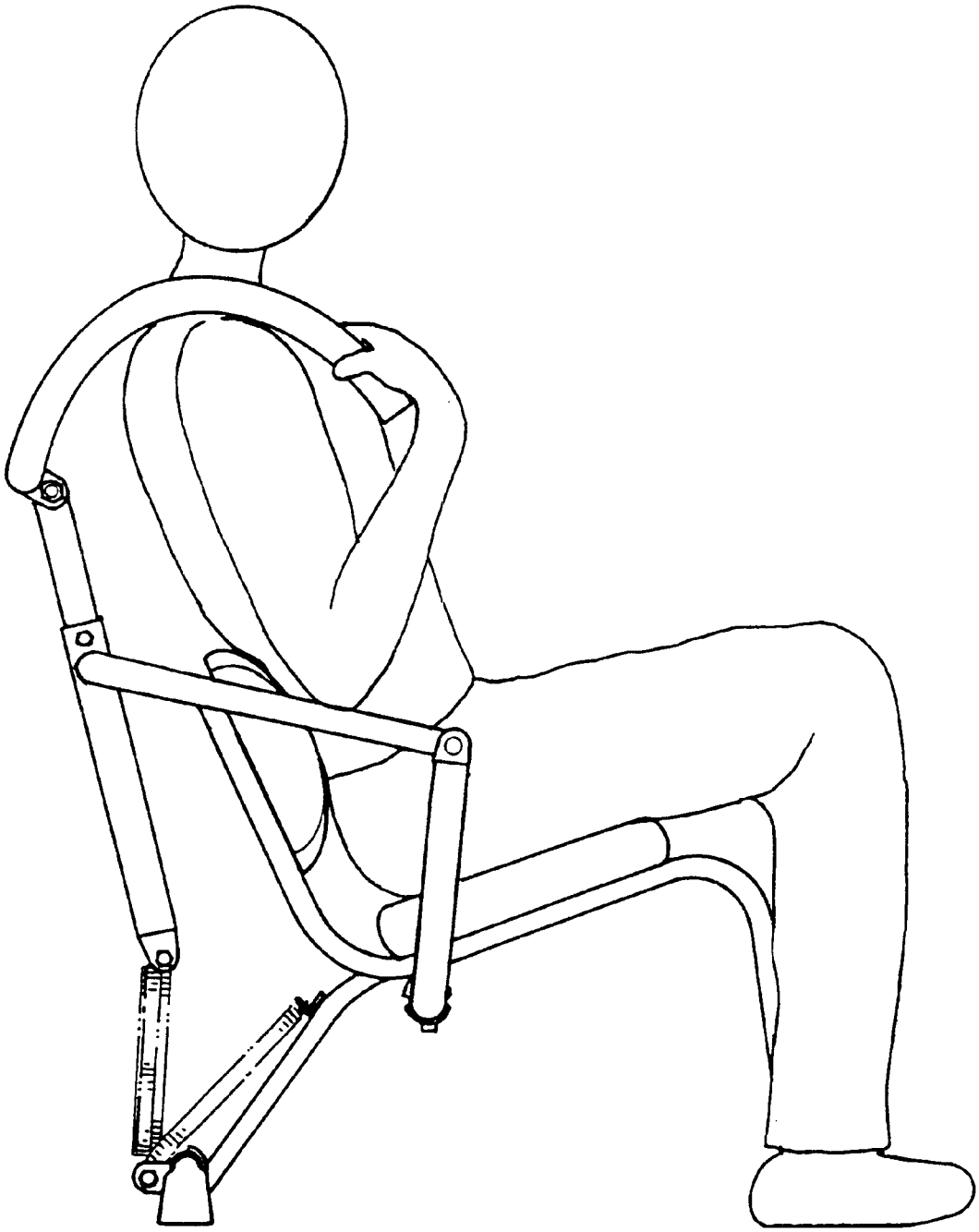
FIGS. 5*a*–5*c* are schematic views showing the sequence of operating the abdominal exerciser in accordance with the first preferred embodiment of the present invention.
Figure 5B:
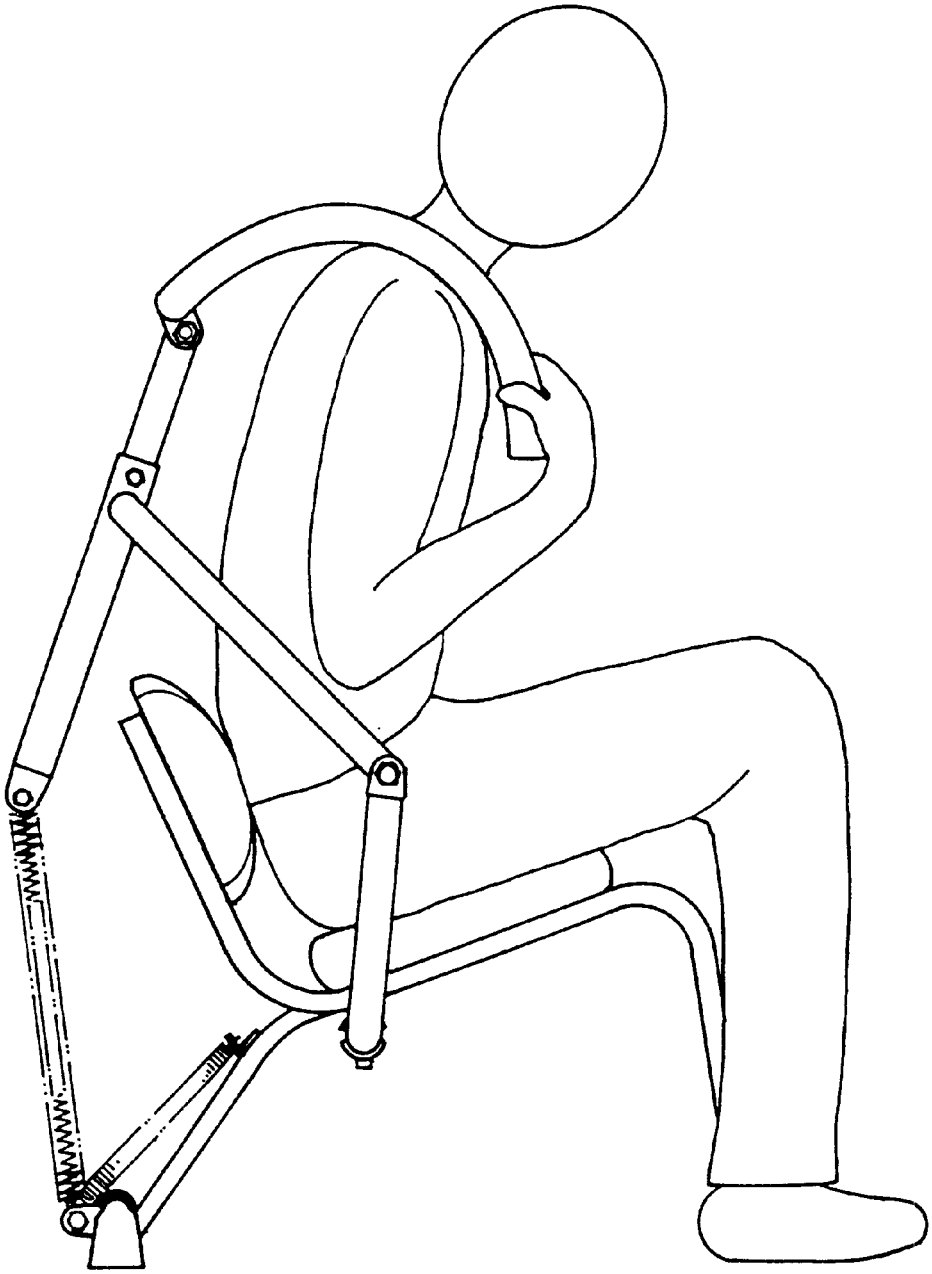
Figure 5C:
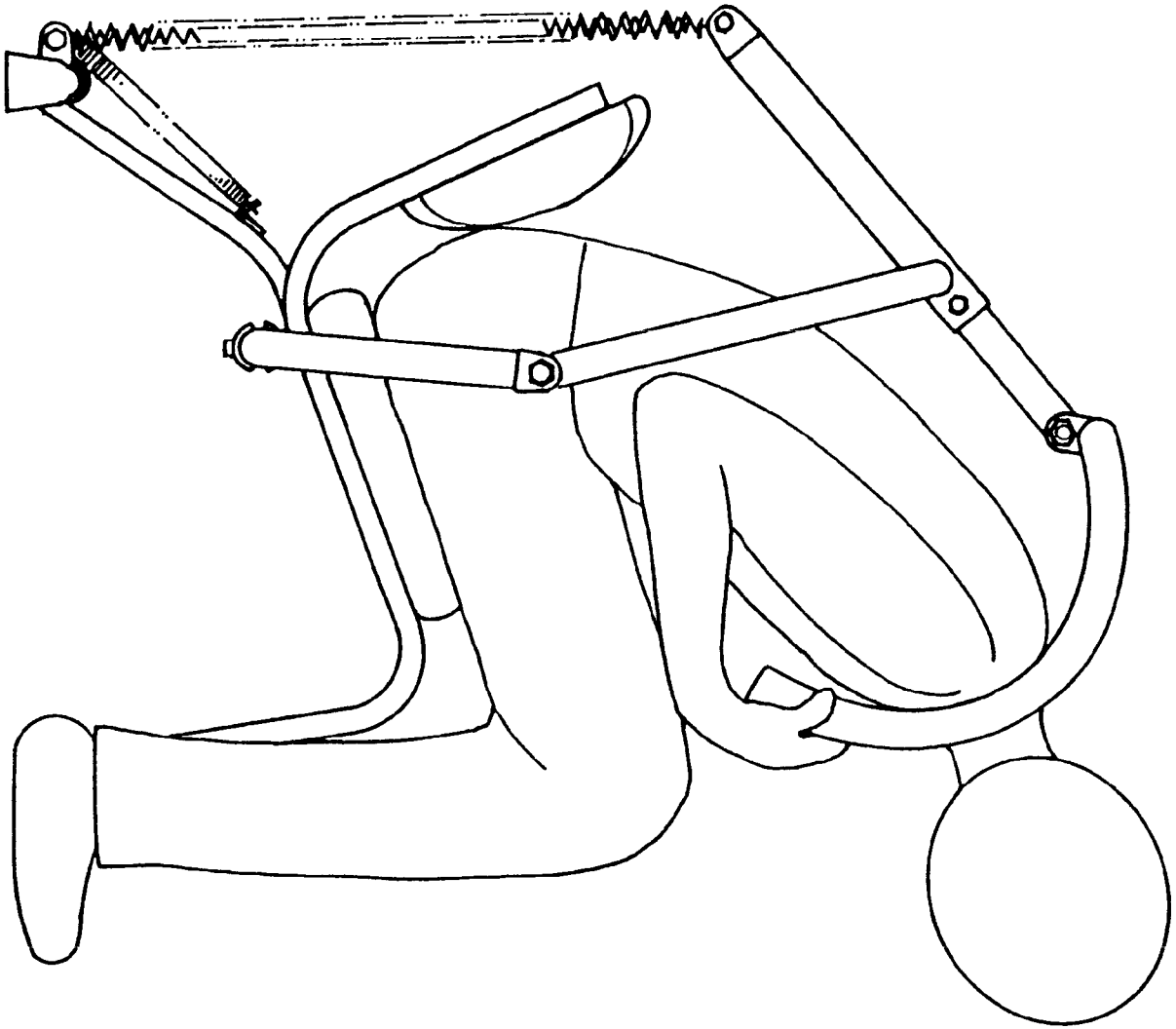

As more clearly shown in FIGS. 2 and 4, a resilient mechanism 21 is disposed between the rear horizontal beam 114 on the rear end 112 of the base frame 11 and the second end 162 of the vertical bar 16. In the current embodiment, the resilient mechanism 21 includes a middle primary elastic member or primary spring 211 and a plurality of secondary elastic members or secondary springs 212 evenly disposed on both sides of the primary spring 211. Each spring 211, 212 has a fixed end and a free end. The fixed end of each spring 211, 212 is connected to the rear horizontal beam 114 of the rear end 112 of the base frame 11 and the free end of each spring 211, 212 is selectively connected to the second end 162 of the vertical bar 16, depending on the amount of elastic force desired. In addition, the free ends of the unused springs can be removed from the second end 162 of the vertical bar 16 and mounted onto the base frame 11.

The above structure constitutes the abdominal exerciser 1 in accordance with the first preferred embodiment of the present invention. As shown in FIGS. 1, 2 and 5*a*–5*c*, in using the abdominal exerciser 1, the user first selects the desired number of springs 211, 212, and/or the type of the springs 211, 212. The user then sits on the seat pad 121 with his/her back lying against the back rest 122, and grabs the handle grips 172 by both hands to secure the handle grips 172 to the user's shoulders. At this moment, the user has to exercise his abdominal muscle such that his/her upper half body can incline forwards and downwards by using the waist as a centre of rotation, so as to further overcome the elastic force generated by springs 211, 212, and to move the combination of the handle 17, the vertical bar 16 and the upper arm 13 in accordance with the movement of the user's body and using the pivot point 15 as a centre of rotation. The objective of the present invention is thus achieved.

According to the first preferred embodiment of the present invention, the handle grip 172 can only move longitudinally and thus the effect thereby focuses on reducing the fat accumulated on the middle portion of the abdomen, but has no remarkable effect on reducing the fat on both sides of the abdomen. To improve this situation, the abdominal exerciser in accordance with the second preferred embodiment of the present invention modifies the combination of the handle grip, the horizontal bar and the vertical bar (see FIGS. 6 and 7). In the second preferred embodiment, the element identical to the one disclosed in the first preferred embodiment is denoted by the same reference numeral with a single quotation mark (').

Figure 6:
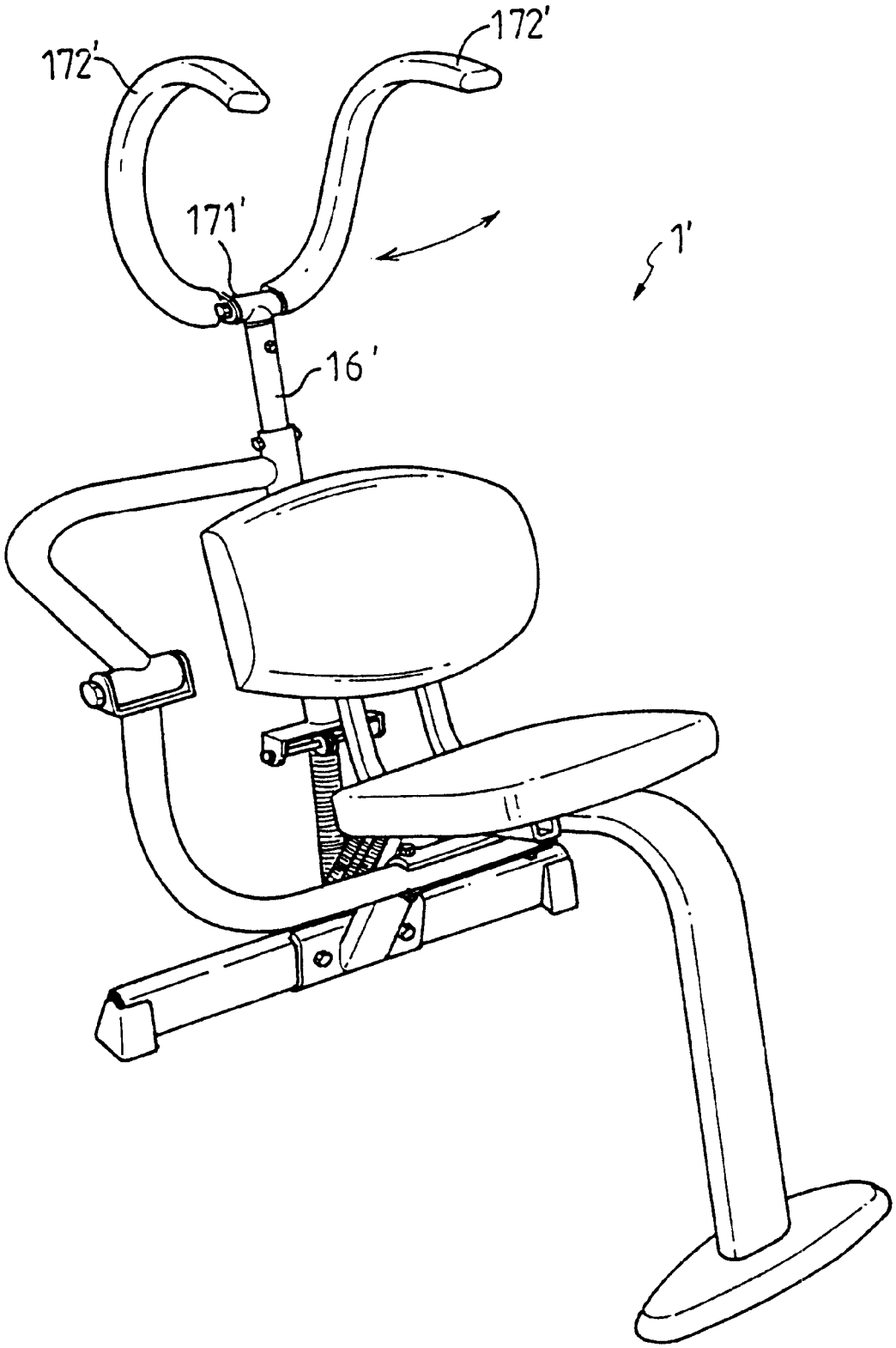
FIG. 6 is a front perspective view of an abdominal exerciser in accordance with the second preferred embodiment of the present invention.
Figure 7:
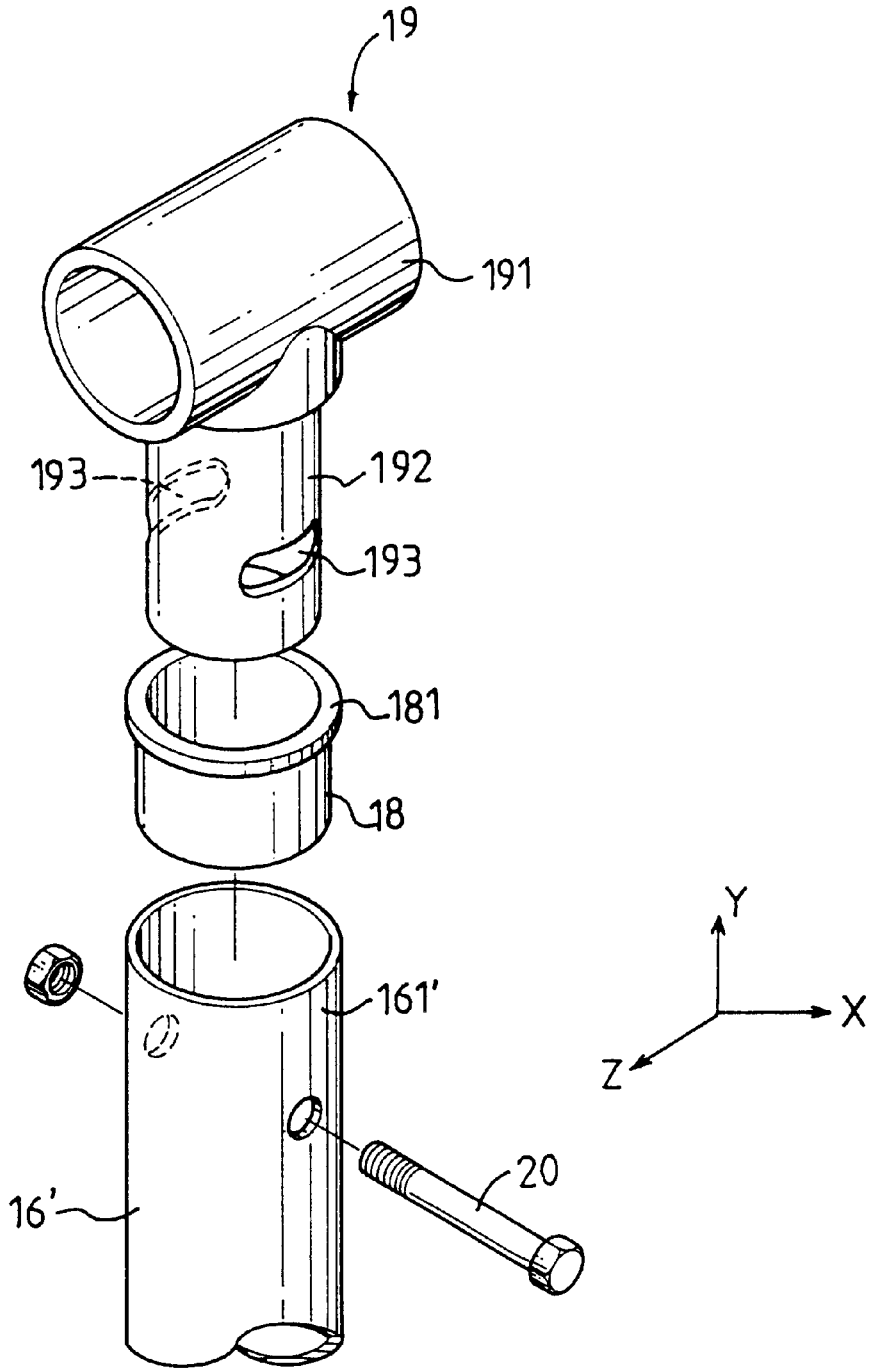
FIG. 7 is a partially exploded view showing the combination of the T-shaped joint and the vertical bar of FIG. 6.

As illustrated in FIGS. 6 and 7, in the abdominal exerciser 1' in accordance with the current embodiment, a sleeve 18 and a hollow T-shaped joint 19 are further disposed on the first end 161' of the vertical bar 16'. The sleeve 18 has a flange 181 which allows the sleeve 18 to fit into the first end 161' of the vertical bar 16' with the flange 181 pressing against the edge of the first end 161' of the vertical bar 16'. The T-shaped joint 19 has a horizontal portion 191 and a vertical portion 192. The horizontal bar 171' passes through the horizontal portion 191 of the joint 19. Further, the vertical portion 192 of the joint 19 forms a pair of diametrically opposite circumferential grooves 193 thereon and fits into the sleeve 18 such that the sleeve 18 is located between the vertical portion 192 of the joint 19 and the first end 161' of the vertical bar 16'. The joint 19 further includes a first bolt 20 such that when the first bolt 20 is inserted through the first end 161' of the vertical bar 16' and the grooves 193, the joint 19 is adapted to rotate with respect to the vertical bar 16' within a certain range and engage with the vertical bar 16'.

Further, since the function of the sleeve 18 lies in reducing the friction resulted from the direct contact between the vertical portion 192 of the joint 19 and the vertical bar 16', the outer surface of the sleeve 18 is smooth and the sleeve 18 is preferably made of hard plastic materials or other wear-resistant materials. In addition, the longitudinal length of the sleeve 18 is less than the distance from the first bolt 20 to the edge of the first end 161' of the vertical bar 16' so as to avoid interfering the insertion of the bolt 20 into the vertical portion 192 of the joint 19.

By using the abdominal exerciser 1' of the second preferred embodiment of the present invention, the user first turns his/her upper half body an angle and then inclines forwards and downwards. The muscle at the side of the abdomen to which the body turns is exercised and the fat on the side can be reduced accordingly.

Figure 8:
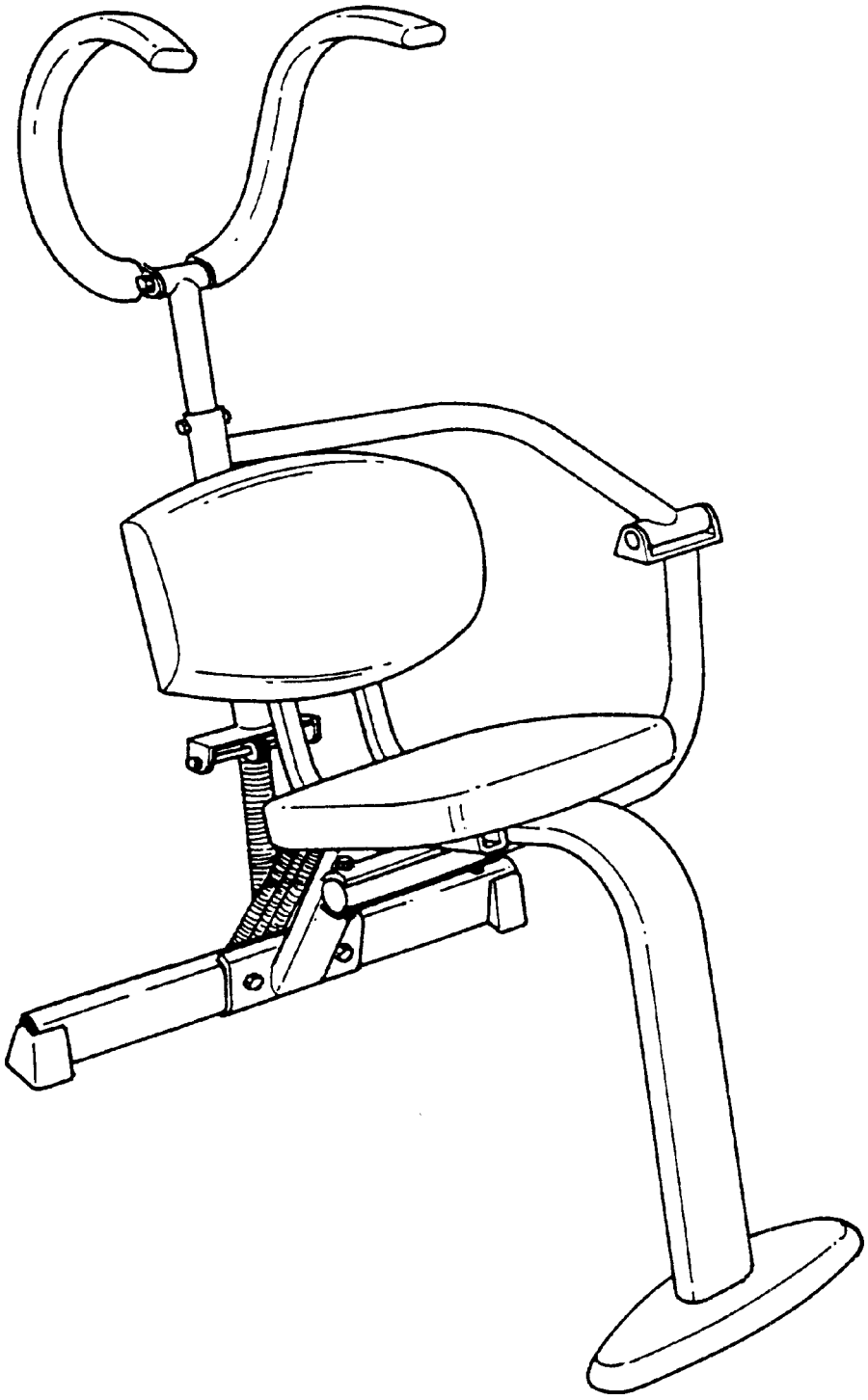
FIG. 8 is a front perspective view of an abdominal exerciser in accordance with the third preferred embodiment of the present invention.

FIG. 8 is a front perspective view of an abdominal exerciser in accordance with the third preferred embodiment of the present invention, which differs from the abdominal exerciser of the first preferred embodiment in that in the third preferred embodiment, the upper arm, the lower arm and the pivot point are arranged on the right side of the seat to meet some users' requirement. Further, even though it is not illustrated, the same combination of the upper arm, the lower arm and the pivot point can be arranged on both sides of the seat.

The abdominal exerciser in accordance with the fourth preferred embodiment of the present invention modifies the connection between the upper arm and the lower arm. In the current embodiment, the element identical to the one disclosed in the first preferred embodiment is denoted by the same reference numeral.

To further increase the difficulty in operation, namely the degree of exerting forces, and to increase the consumption of the energy, the abdominal exerciser 1 in accordance with the fourth embodiment of the present invention disposes a second resilient mechanism 22 between the upper arm 13 and the lower arm 14. In addition to the elastic force resulted from the resilient mechanism 21, the user has to overcome the elastic force resulted from the second resilient mechanism 22, such that the upper arm 13 can rotate with respect to the lower arm 14.

Figure 9:
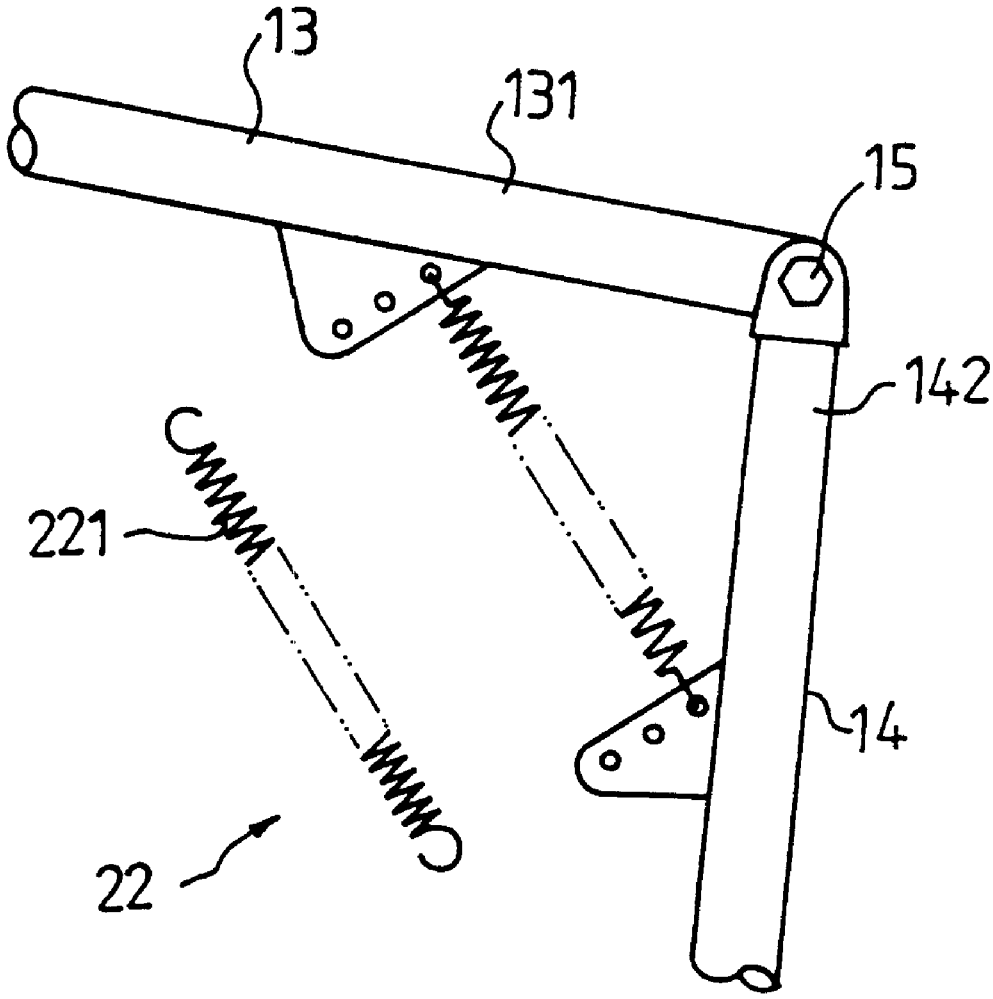
FIG. 9 is a partially enlarged view of the second resilient mechanism of an abdominal exerciser in accordance with the fourth preferred embodiment of the present invention.
Figure 10:
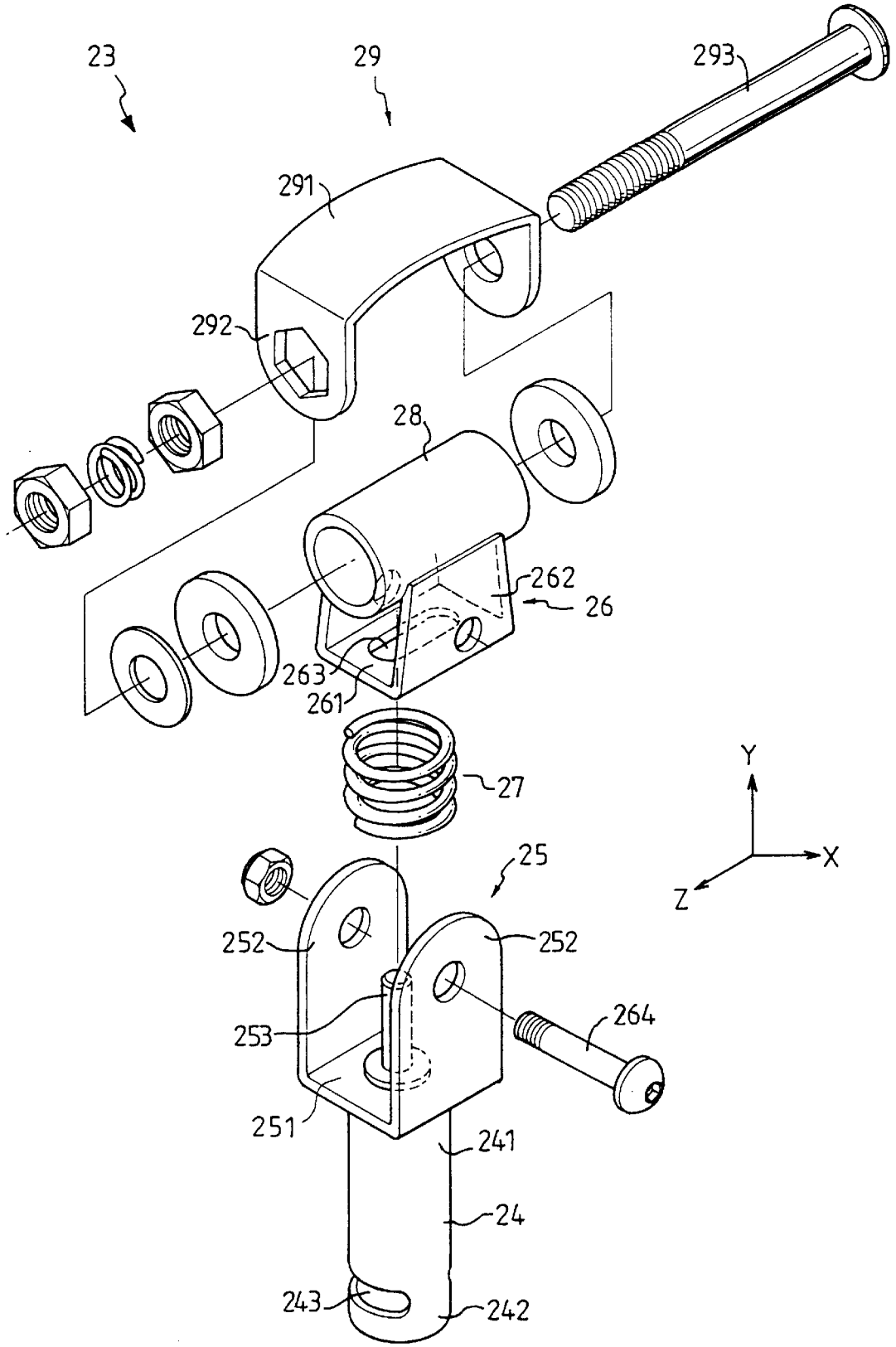
FIG. 10 is an exploded view of the universal joint of an abdominal exerciser in accordance with the fifth preferred embodiment of the present invention.
Figure 11:
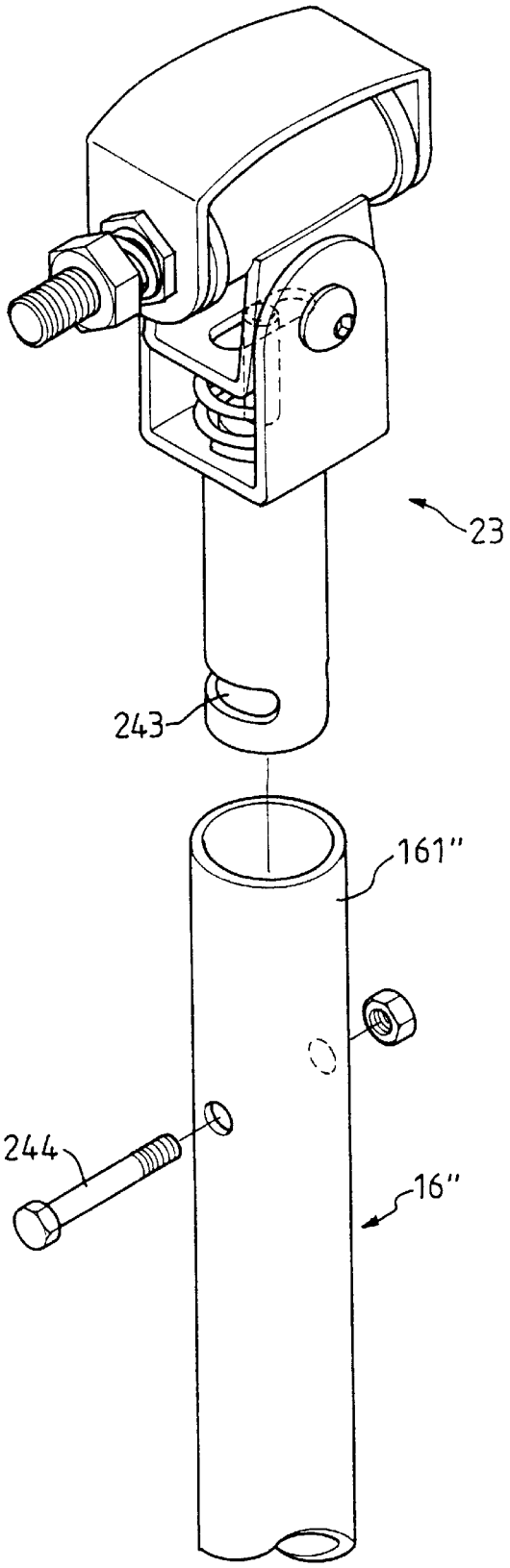
FIG. 11 is a partially exploded view showing the combination of the universal joint and the vertical bar of FIG. 10.

As shown in FIG. 9, the second resilient mechanism 22 comprises a plurality of elastic members or springs 221. An end of each spring 221 connects to upper arm 13, near the first end 131 thereof, and the opposite end of each spring 221 connects to the lower arm 14, near the second end 142 thereof. Accordingly, the user can also select the desired numbers of springs 221, and/or the types of the springs 221, depending on the elastic force desired.

In the abdominal exerciser 1' in accordance with the second embodiment of the present invention (see FIGS. 6 and 7), the horizontal bar 171' of the handle 17' can only rotate with respect to the vertical bar 16' on an X-Y plane and an X-Z plane, but cannot rotate on a Y-Z plane such that the user's abdomen cannot be exercised completely. Accordingly, the abdominal exerciser in accordance with the fifth preferred embodiment of the present invention modifies the combination of the handle grips, the horizontal bar and the vertical bar. In the fifth preferred embodiment, the element identical to the one disclosed in the first preferred embodiment is denoted by the same reference numeral with a double quotation mark (").

As shown in FIGS. 10–14, in the abdominal exerciser 1" of the current preferred embodiment, a universal joint 23 is disposed on the first end 161" of the vertical bar 16". The universal joint 23 comprises a vertical tube 24, a first support 25, a second support 26, a spring 27, a hollow horizontal tube 28 and a top mount 29.

The vertical tube 24 has a first end 241 and a second end 242. The vertical tube 24 is formed with a pair of diametrically opposite circumferential grooves 243 near the second end 242 thereof. In addition, the second end 242 of the vertical tube 24 fits to the first end 161" of the vertical bar 16". When a second bolt 244 is inserted through the first end 161" of the vertical bar 16" and the grooves 243 of the vertical tube 24, the vertical tube 24 can engagingly rotate with respect to the vertical bar 16" within a certain range (see FIG. 11).

The first support 25 is located above the first end 241 of the vertical tube 24. The first support 25 is preferred ⊔-shaped, and has a bottom wall 251 connecting on the first end 241 of the vertical tube 24, two parallel and opposite lateral walls 252 perpendicularly connecting to the bottom wall 251, and a post 253 protruding from the bottom wall 251 and disposed between the lateral walls 252.

The second support 26 is preferably ⊔-shaped and has a bottom wall 261 and two parallel and opposite lateral walls 262 perpendicularly connecting to the bottom wall 261. The bottom wall 261 is formed with an elongated slot 263 thereon the slot 263 is oriented to comply with the lateral walls 262. By inserting a third bolt 264 through the lateral walls 262 of the second ⊔-shaped support 26 and the lateral walls 252 of the first ⊔-shaped support 25, and by inserting the post 253 of the first ⊔-shaped support 25 through the spring 27 and into the slot 263 of the second ⊔-shaped support 26, the second ⊔-shaped support 26 is received in and pivots on the first z,900 -shaped support 25 and the spring 27 is located between the bottom wall 251 of the first ⊔-shaped support 25 and the bottom wall 261 of the second ⊔-shaped support 26.

The hollow horizontal tube 28 has a longitudinal axis oriented to comply with the elongated slot 263 of the second ⊔-shaped support 26 and connects onto the two lateral walls 262 of the second ⊔-shaped support 26.

The top mount 29 is preferably ⊓-shaped and has a top wall 291 and two parallel and opposite lateral walls 292 perpendicularly connecting to the top wall 291. Each lateral wall 292 of the ⊓-shaped top mount 29 respectively closes an end of the horizontal tube 28. By inserting a fourth bolt 293 through the lateral walls 292 of the ⊓-shaped top mount 29, the hollow horizontal tube 28 and some washers and a spring, the horizontal tube 28 is received in and pivots on the ⊓-shaped top mount 29.

Based on the above arrangement, the universal joint 23 for the abdominal exerciser 1" in accordance with the fifth present embodiment of the present invention is presented. By further connecting the top wall 291 of the ⊓-shaped top mount 29 to the horizontal bar 171" of the handle 17 and inserting the second bolt 244 into the first end 161" of the vertical bar 16" and the grooves 243 of the vertical tube 24, the universal joint 23 is disposed between the handle 17" and the vertical bar 16" (see FIG. 12).

Figure 12:
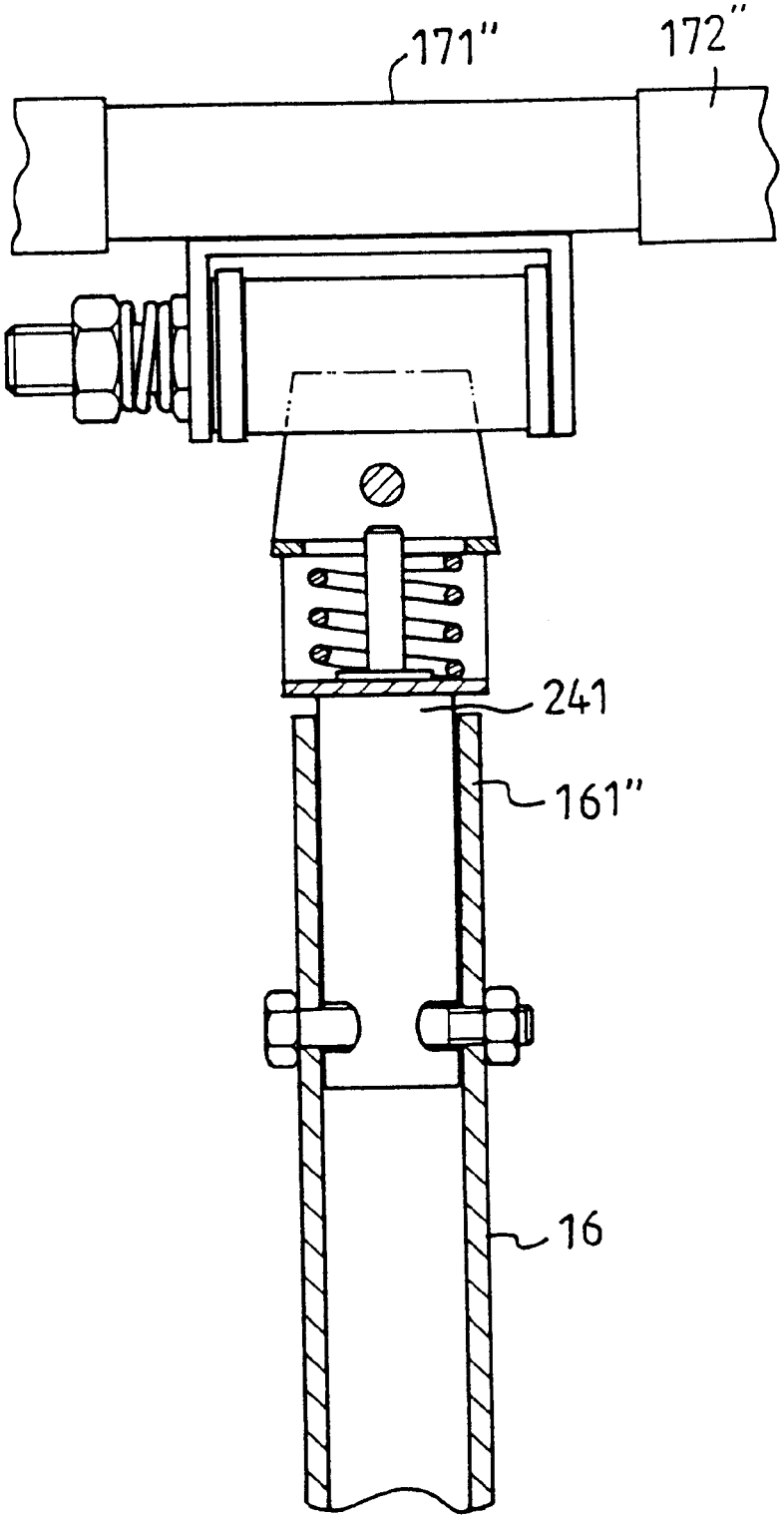
FIG. 12 is a cross-sectional view showing the combination of the universal joint, the vertical bar, and the horizontal bar of the handle of FIG. 10.
Figure 13:
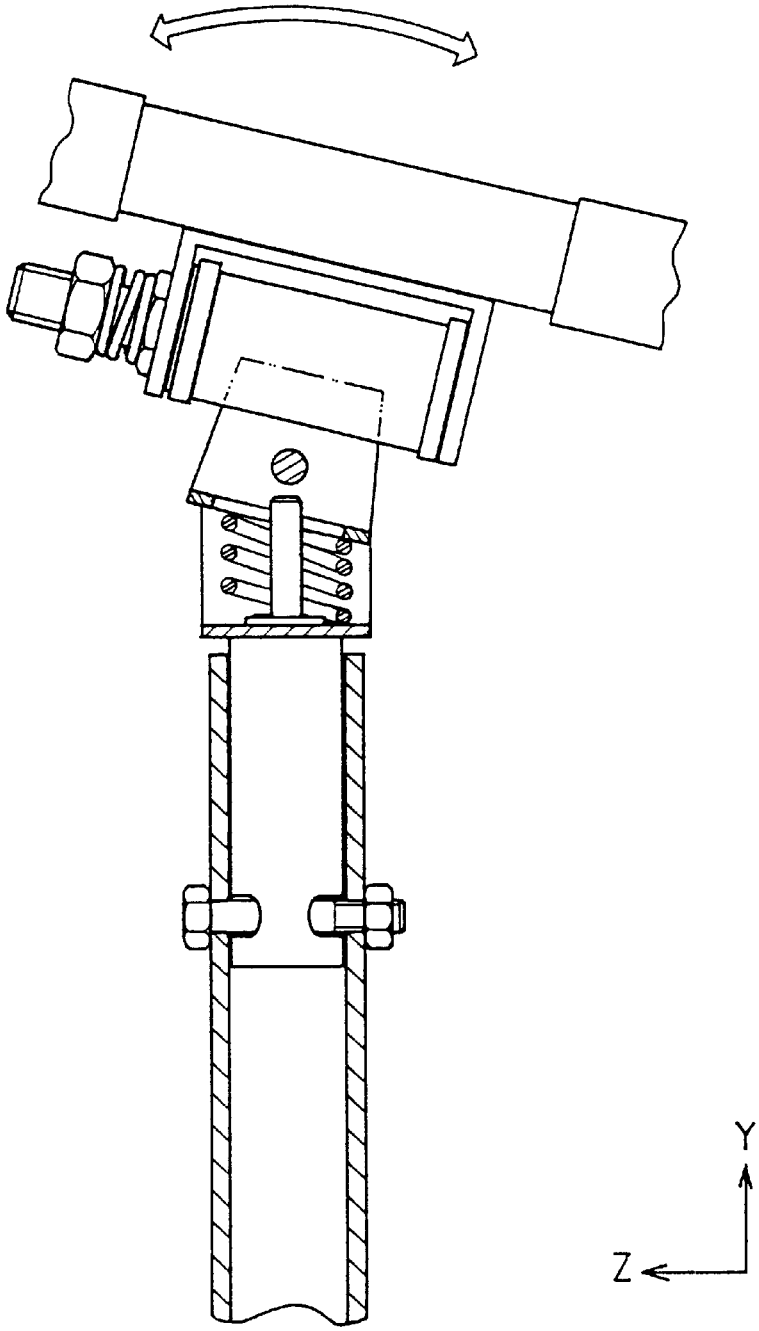
FIG. 13 is a side operational view of the universal joint of FIG. 10.

Accordingly, the handle 17" can rotate on the X-Y plane by using the fourth bolt 293 as the center of rotation, on the Y-Z plane by using the third bolt 264 as the center of rotation, and on the Z-X plane by using the vertical tube 24 as the center of rotation. The objective of exercising the abdominal muscle in all directions is thus obtained. Moreover, because of the provision of the spring 27, by exerting force onto the handle 17" along the Y-Z plane, the bottom wall 261 of the second ⊓-shaped support 26 presses against the spring 27, as shown in FIG. 13. When the force is diminished, the spring 27 presses the bottom wall 261 of the second ⊓-shaped support 26 to move back to its original position, such that the handle 17" can be restored to its original position on the Y-Z plane, as shown in FIG. 12.

Figure 14:
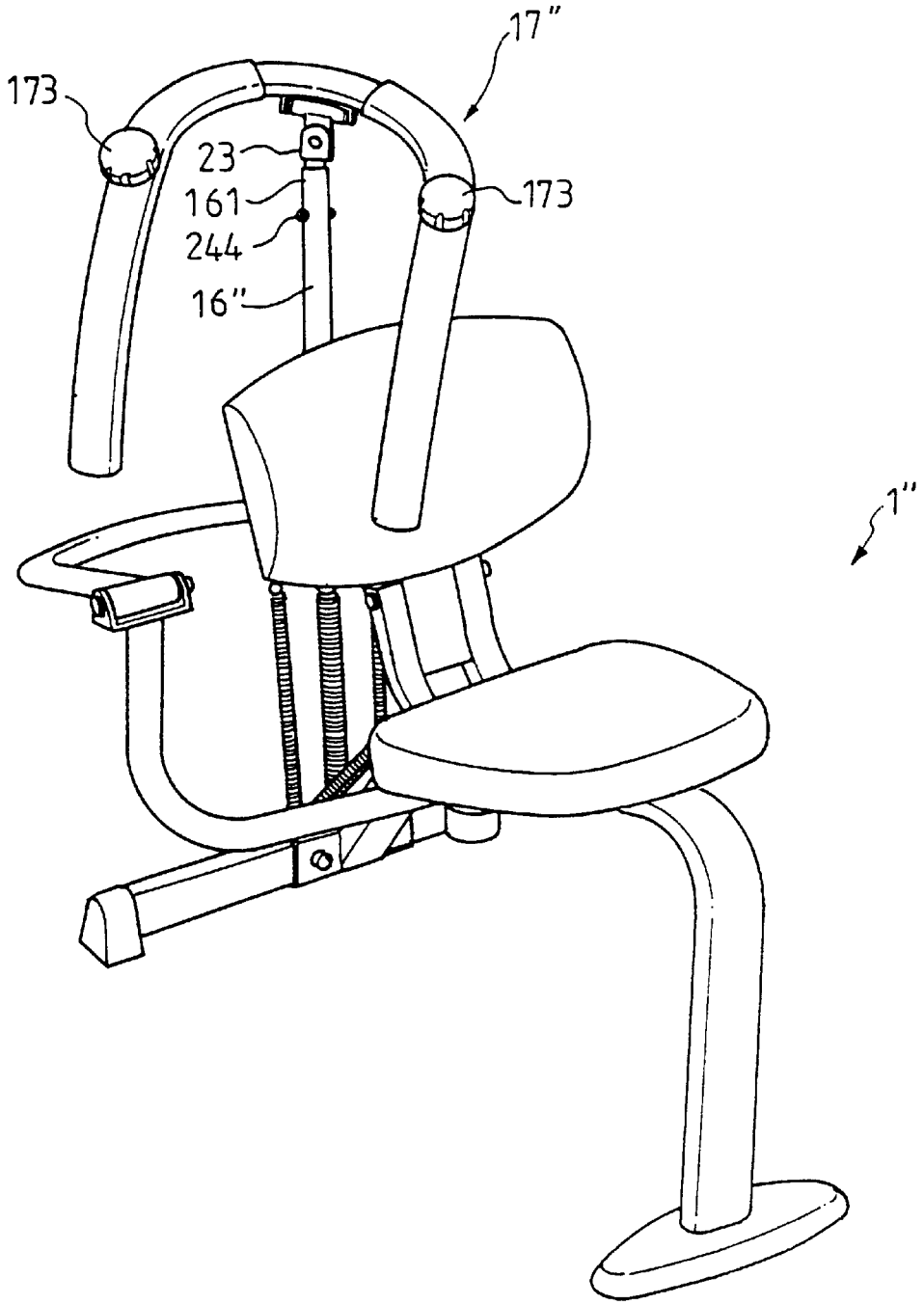
FIG. 14 is a front perspective view of an abdominal exerciser in accordance with the fifth preferred embodiment of the present invention.

As shown in FIG. 14, to meet the requirement of such an all-directional abdominal exercise, a knob 173 can be provided on each of the handle grip 172" to benefit the gripping of the user's hands. In addition, even though it is not illustrated, in the current preferred embodiment, a sleeve can be inserted between the vertical tube 24 and the vertical bar 16". In addition, the outer surface of the sleeve is smooth and the sleeve is preferably made of hard plastic materials or other wear-resistant materials so as to reduce the friction resulted from the direct contact between the vertical tube 24 of the joint 23 and the vertical bar 16".

Figure 15:
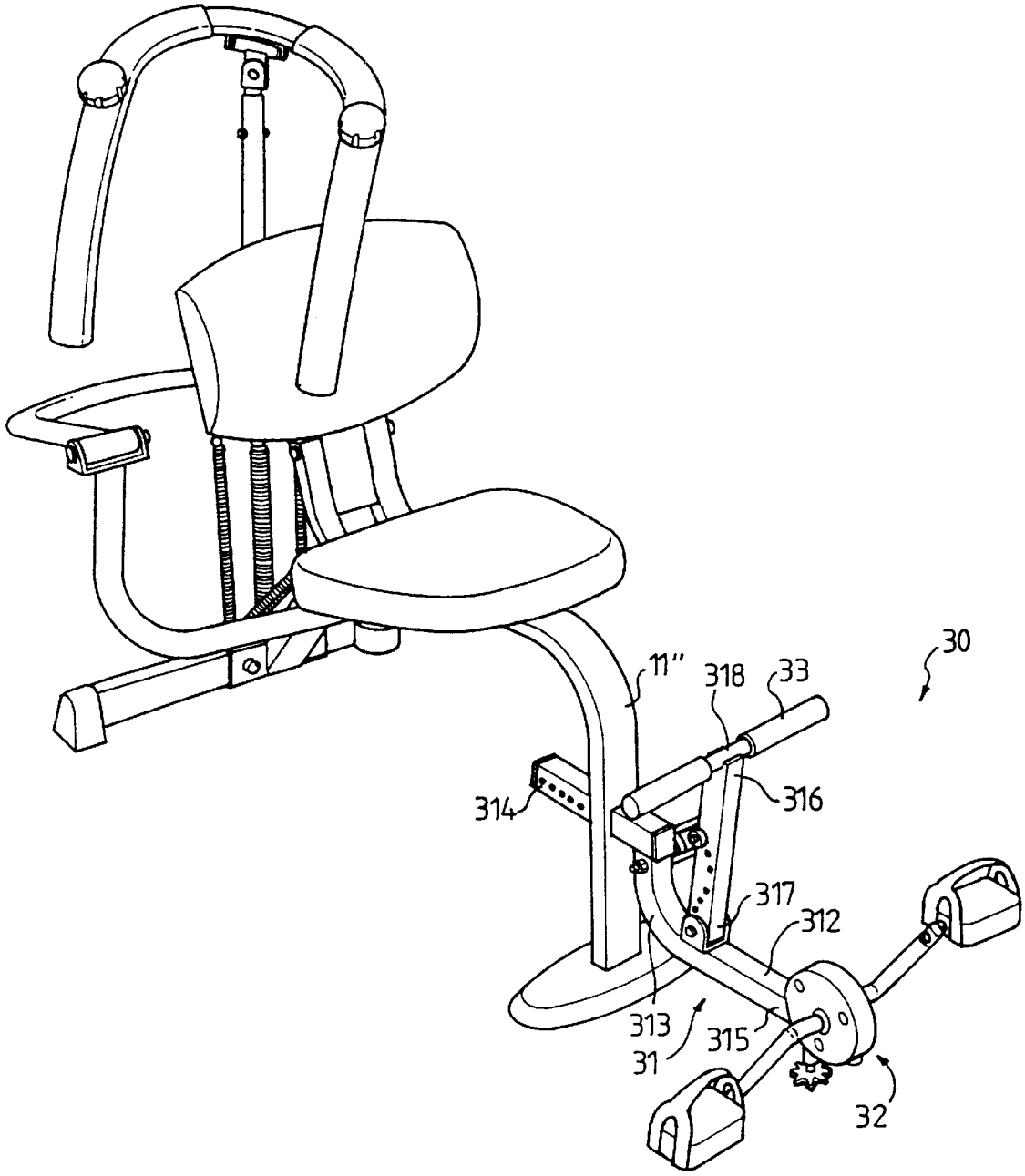
FIG. 15 is a front perspective view showing a configuration of an abdominal exerciser in accordance with the sixth preferred embodiment of the present invention.
Figure 16:
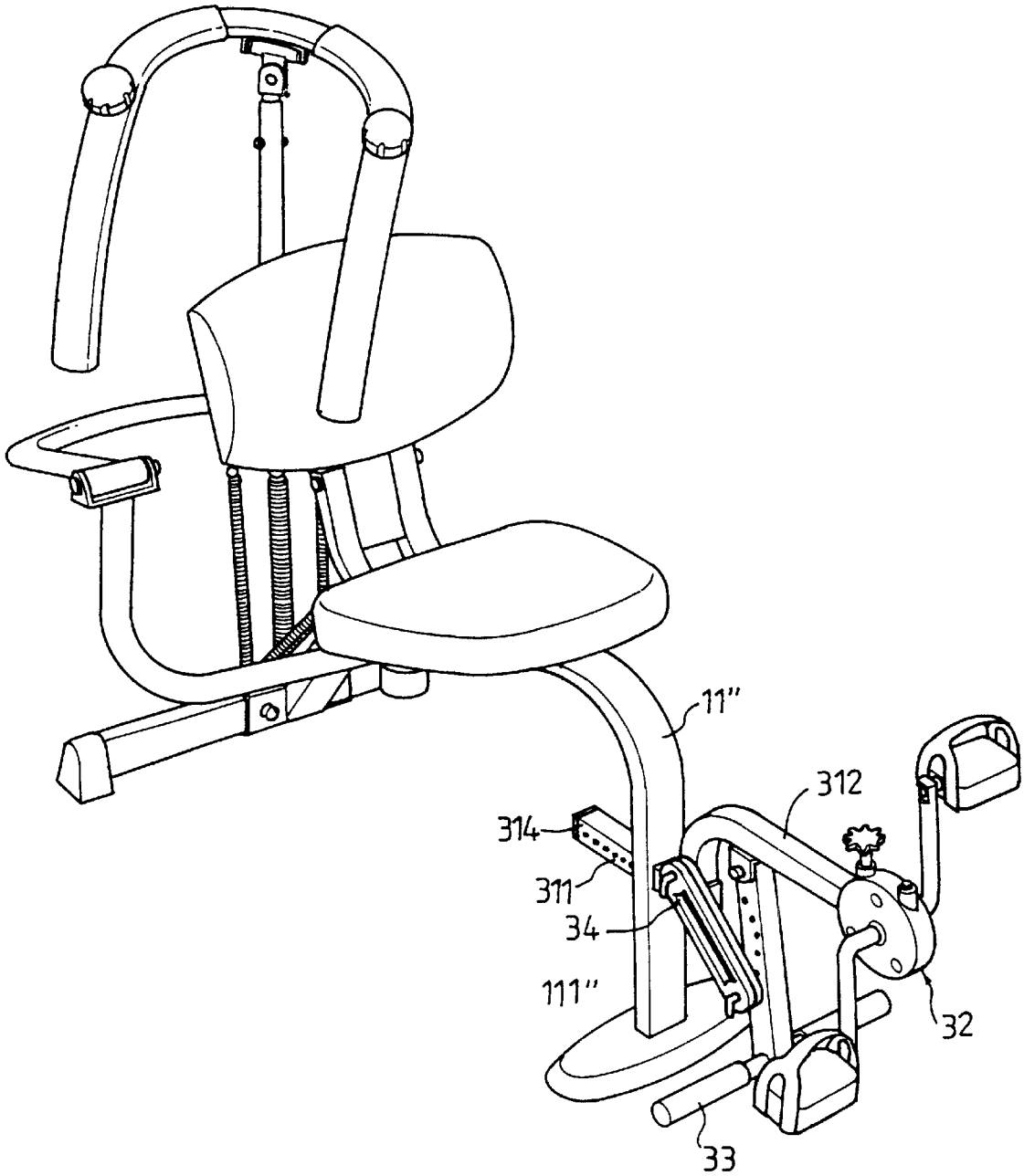
FIG. 16 is a front perspective view showing the other configuration of an abdominal exerciser in accordance with the sixth preferred embodiment of the present invention.

While reducing fat in the abdomen, if the user's legs can be exercised simultaneously, double effects can be obtained. FIGS. 15 and 16 show the perspective of an abdominal exerciser in accordance with the sixth embodiment of the present invention, which modifies the abdominal exerciser 1" in accordance with the fifth embodiment of the present invention. As shown, a leg exercising mechanism 30 is disposed onto the base frame 11", near the front end 111" thereof. The leg exercising mechanism 30 substantially comprises a fixture 31, a conventional exercise bike 32 for exercising the muscle of thighs and calves, and a pair of horizontal levers 33.

The fixture 31 comprises a first horizontal arm 311, a second horizontal arm 312 and a connection arm 313 connecting to an end of the first horizontal arm 311 at an end thereof, and to an end of the second horizontal arm 312 at an opposite end thereof such that the other end of the first horizontal arm 311 and the other end of the second horizontal arm 312 represent a first end 314 and a second end 315 of the fixture 31, respectively.

The fixture 31 further comprises a vertical arm 316 and a third resilient mechanism 34. The vertical arm 316 has a first end 317 pivotally connecting to the first horizontal arm 311 and a second end 318 having the pair of the horizontal levers 33 extending therefrom. The third resilient mechanism 34 is provided between the connection arm 313 and the vertical arm 316 to confine the movement of the vertical arm 316. Moreover, in the current embodiment, the third resilient mechanism 34 comprises an elastic member or a rubber band having an end connecting between the first horizontal arm 311 and the connection arm 313, and an opposite end adjustably connecting to the vertical arm 316.

The exercise bike 32 is connected to the second end 315 of the fixture 31. Since the exercise bike 32 is conventional, its structure is not specifically depicted.

The leg exercising mechanism 30 is accordingly constructed. As shown in FIG. 15, when the exercise bike 32 is to be used, the fixture 31 is oriented to position the exercise bike 32 downwards and the first end 314 of the fixture 31 is inserted into one of the holes preformed on the base frame 11", at the front end 111" thereof. The first horizontal arm 311 can be formed with a plurality of holes thereon so as to adjust the distance of the first horizontal arm 311 inserted into the base frame 11" by means of a pin (not illustrated).

Alternatively, as shown in FIG. 16, when the horizontal levers 33 are to be used to exercise the user's muscle of calves, the fixture 31 is oriented to position the pair of horizontal levers 33 downward. The first end 314 of the fixture 31 is again inserted into and fixed to one of the holes preformed on the base frame 11", near the front end 111" thereof. The user then presses his shins against the horizontal lever pair 33 to exert force to overcome the force generated from the third resilient mechanism 34 to achieve the objective of exercising the muscle of calves.

Even though the resilient mechanisms 21 and 22 in each of the preferred embodiments are springs (as shown in FIGS. 3 and 9), other resilient mechanisms, such as rubber bands, pneumatic members, hydraulic members, and other force adjustable members fall within the scope of protection of the present invention. Similarly, the third resilient mechanism 34 (as shown in FIG. 16) can also comprise springs, pneumatic members, hydraulic members, and other force adjustable members.

The structure of the present invention is not limited to the above embodiments. Although the invention has been described with reference to the preferred embodiments, it will be obvious to persons skilled in the art that various changes and modifications may be made without departing from the scope of the invention as recited in the claims.

What is claimed is:

1. An abdominal exerciser, comprising:

a base frame;

a seat having a seat pad which is secured on the base frame;

an upper arm having a first end and a second end;

a lower arm having a first end and a second end, the first end of the lower arm connecting on and laterally extending from the base frame, the second end of the lower arm pivotally connecting to the first end of the upper arm;

a vertical bar being located behind the seat pad and connecting with the second end of the upper arm, the vertical bar having a first end and a second end;

a handle pivotally connecting to the first end of the vertical bar; and a resilient mechanism interconnecting the base frame and the second end of the vertical bar.

2. The abdominal exerciser according to claim 1, wherein the base frame has substantially an arched shape, and has a front horizontal beam and a rear horizontal beam provided on a front end and a rear end of the base frame, respectively, and wherein the upper arm and the lower arm are both L-shaped.

3. The abdominal exerciser according to claim 1, further comprising a pair of support arms and a back rest substantially perpendicularly connecting to the seat pad by means of the pair of support arms.

4. The abdominal exerciser according to claim 1, wherein the second end of the lower arm pivotally connects to the first end of the upper arm at a pivot point, whereby when the user sits on the seat pad, the pivot point substantially aligns with the user's waist.

5. The abdominal exerciser according to claim 2, wherein the resilient mechanism is adapted to carry out an adjustable elastic force, the resilient mechanism comprising a plurality of elastic members, each of the elastic members being connected to the rear end of the base frame at an end thereof and selectively connected to the second end of the vertical bar at an opposite end thereof.

6. The abdominal exerciser according to claim 5, wherein the elastic members includes a middle primary elastic member disposed on the second end of the vertical bar and a plurality of secondary elastic members evenly disposed on both sides of the primary elastic member.

7. The abdominal exerciser according to claim 6, wherein the elastic members are rubber bands.

8. The abdominal exerciser according to claim 2, wherein the handle further comprises a horizontal bar pivotally connecting to the first end of the vertical bar and handle grips extending from opposing ends of the horizontal bar, each of the handle grips having a substantially hooked shape to comply with a user's shoulder and having a knob provided thereon.

9. The abdominal exerciser according to claim 8, further comprising a T-shaped joint disposed on the first end of the vertical bar, the horizontal bar passing through a horizontal portion of the joint, a vertical portion of the joint formed with a pair of diametrically opposite circumferential grooves, wherein the joint further includes a first bolt, such that when the first bolt is inserted through the first end of the vertical bar and the grooves of the joint, the joint is adapted to rotate with respect to the vertical bar within a certain range and engage with the vertical bar.

10. The abdominal exerciser according to claim 9, further comprising a sleeve fitting between the vertical portion of the joint and the first end of the vertical bar.

11. The abdominal exerciser according to claim 2, further comprising a second resilient mechanism provided between the upper arm and the lower arm.

12. The abdominal exerciser according to claim 11, wherein the second resilient mechanism comprises a plurality of elastic members, each having an end connecting to the upper arm and an opposite end connecting to the lower arm.

13. The abdominal exerciser according to claim 12, wherein the elastic members are rubber bands.

14. The abdominal exerciser according to claim 8, further comprising a universal joint which includes:

a vertical tube having a first end and a second end, the vertical tube formed with a pair of diametrically opposite circumferential grooves near the second end thereof, the second end of the vertical tube fitting to the first end of the vertical bar;

a second bolt being inserted through the first end of the vertical bar and the grooves of the vertical tube such that the vertical tube can engagingly rotate with respect to the vertical bar within a certain range;

a first support having a bottom wall connecting on the first end of the vertical tube, two opposite lateral walls connecting to the bottom wall, and a post protruding from the bottom wall and disposed between the lateral walls;

a second support having a bottom wall with an elongated slot formed thereon and two opposite lateral walls connecting to the bottom wall, the slot being oriented to comply with the lateral walls and receiving the post of the bottom wall inserted therethrough;

a third bolt being inserted through the lateral walls of the second support and the lateral walls of the first support so that the second support is received in and pivots on the first support;

a horizontal tube having an longitudinal axis oriented to comply with the elongated slot of the second support, the horizontal tube connecting onto the two lateral walls of the second support;

a top mount having a top wall and two opposite lateral walls connecting to the top wall, the top wall of the top mount connecting to the horizontal bar and the lateral wall of the top mount respectively closing two ends of the horizontal tube; and a fourth bolt being inserted through the lateral walls of the top mount and the horizontal tube so that the horizontal tube is received in and pivots on the top mount.

15. The abdominal exerciser according to claim 14, further comprising a spring fitting onto the post and being disposed between the bottom wall of the first support and the bottom wall of the second support.

16. The abdominal exerciser according to claim 14, wherein the first support and the second support are both ⊔-shaped and the top mount is ⊓-shaped.

17. The abdominal exerciser according to claim 2, further comprising an exercise bike and a fixture, the fixture having a first end and a second end, the first end being inserted into and secured to the base frame, at the front end thereof, and the second end connecting with the exercise bike.

18. The abdominal exerciser according to claim 17, wherein the fixture comprises a first horizontal arm, a second horizontal arm and a connection arm connecting to the first horizontal arm at an end thereof, and to an end of the second horizontal arm at an opposite end thereof.

19. The abdominal exerciser according to claim 18, wherein the fixture further comprises a vertical arm having a first end pivotally connecting to the first horizontal arm, a second end having a pair of the horizontal levers extending therefrom, and a third resilient mechanism provided between the connection arm and the vertical arm.

20. The abdominal exerciser according to claim 19, wherein the third resilient mechanism comprises at least an elastic member having an end connecting between the first horizontal arm and the connection arm, and an opposite end connecting to the vertical arm.

* * * * *